US010414038B2

(12) United States Patent
Wasylow

(10) Patent No.: US 10,414,038 B2
(45) Date of Patent: Sep. 17, 2019

(54) STORAGE CABINET SYSTEM AND METHOD

(71) Applicant: Ryan Daniel Jackson Wasylow, New Westminster (CA)

(72) Inventor: Ryan Daniel Jackson Wasylow, New Westminster (CA)

( * ) Notice: Subject to any disclaimer, the term of this patent is extended or adjusted under 35 U.S.C. 154(b) by 0 days.

(21) Appl. No.: 15/860,473

(22) Filed: Jan. 2, 2018

(65) Prior Publication Data

US 2019/0202047 A1 Jul. 4, 2019

(51) Int. Cl.

| | |
|---|---|
| ***B25H 3/04*** | (2006.01) |
| ***B66F 13/00*** | (2006.01) |
| *B66F 11/04* | (2006.01) |

(52) U.S. Cl.

CPC ..... *B25H 3/04* (2013.01); *B66F 13/00* (2013.01); *B66F 11/044* (2013.01)

(58) Field of Classification Search

CPC ..... B25H 3/04; B66F 13/00; B66F 11/044
USPC ..... 224/401
See application file for complete search history.

(56) References Cited

U.S. PATENT DOCUMENTS

| | | | | |
|---|---|---|---|---|
| 3,642,240 | A * | 2/1972 | Hershey | E06C 7/14 211/71.01 |
| 5,024,337 | A * | 6/1991 | Bailey | A47F 5/0807 211/88.01 |
| 5,547,080 | A * | 8/1996 | Klimas | B25H 3/02 182/129 |
| 6,837,383 | B1 * | 1/2005 | McElhaney, Jr. | B25H 5/00 206/373 |
| D550,007 | S * | 9/2007 | Westra | D6/514 |
| 7,275,641 | B1 * | 10/2007 | Purnell | B25H 3/02 206/373 |
| 7,900,746 | B2 | 3/2011 | Fleming | |
| 8,038,110 | B2 | 10/2011 | Talbott | |
| 8,448,959 | B1 * | 5/2013 | Pohot | B25H 3/02 280/47.131 |
| 8,925,683 | B1 * | 1/2015 | Gunsaullus | E06C 1/38 182/129 |
| 9,056,756 | B1 | 6/2015 | De Marco | |
| 9,249,003 | B2 | 2/2016 | Reeves | |
| 9,988,186 | B1 * | 6/2018 | Johnson | B65D 25/22 |
| 2001/0007343 | A1 * | 7/2001 | McElhaney, Jr. | B25H 5/00 248/215 |
| 2006/0021985 | A1 * | 2/2006 | Jasper | B25H 3/02 220/475 |
| 2007/0187184 | A1 | 8/2007 | Nasuti et al. | |
| 2012/0298539 | A1 | 11/2012 | Purnell, Jr. | |

FOREIGN PATENT DOCUMENTS

| | | |
|---|---|---|
| CA | 2850772 | 11/2014 |

* cited by examiner

*Primary Examiner* — Peter N Helvey
(74) *Attorney, Agent, or Firm* — Integrity Patent Group, PLC; Charles E. Runyan

(57) ABSTRACT

A storage cabinet system includes a cabinet-box having a lip for engaging a top-rail of a mechanical lift platform. The cabinet-box further includes a plurality of compartments for holding and storing items. The storage cabinet system is useful for assisting users in holding items while on the mechanical lift platform, thus being more efficient and less hazardous.

18 Claims, 5 Drawing Sheets

STORAGE CABINET SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of storage cabinets of existing art and more specifically relates to storage devices for mechanical lift platforms.

RELATED ART

A mechanical lift platform also known as an aerial device, elevating work platform (EWP), mobile elevating work platform (MEWP), or an aerial boom lift is a mechanical device used to provide temporary access for people or equipment to inaccessible areas, usually at a height. They may be generally used in construction or firefighting sites; both of which require a variety of different tools for the workers to perform their duties. Often these tools may fall from unsafe heights to the workers below, creating a hazardous environment. Further, it is inefficient for the worker to lose or misplace their tools from a height that requires them to be lowered in order to retrieve them. Therefore, a suitable solution is desired.

U.S. Pat. No. 7,900,746 to Robert J. Fleming relates to a lift caddy. The described lift caddy includes a lift caddy for a personnel lift having at least one horizontal member, an engaging surface, and a work platform disposed below the horizontal member in spaced apart vertical relation. The lift caddy includes a container, a mounting hook extending from the container, and a pin insertable through an aperture in the upper portion of the mounting hook to limit horizontal travel of the retaining hook relative to the horizontal member when the mounting hook is positioned on the horizontal member. The container is sized so that at least a portion of the exterior surface rests against the engaging surface of the personnel lift to support the container in a substantially vertical orientation when the mounting hook is positioned on the horizontal member.

SUMMARY OF THE INVENTION

In view of the foregoing disadvantages inherent in the known storage cabinet art, the present disclosure provides a novel storage cabinet system for a mechanical lift. The general purpose of the present disclosure, which will be described subsequently in greater detail, is to provide an efficient and effective storage cabinet system and method.

A storage cabinet system for a mechanical lift having rails is disclosed herein. The storage cabinet system includes a cabinet-box having a horizontal shelf opposite a closed-bottom, a vertical front-wall opposite a vertical back-wall, a vertical right-wall opposite a vertical left-wall, and an interior-volume contained therein. The interior-volume may have a plurality of compartments configured to receive and store items. Further, a lip integrally formed from a 90-degree bend of the vertical front-wall may be configured to engage a top-rail of the mechanical lift platform. The cabinet-box may be configured to hang outside the rails provided with the mechanical lift platform, and the plurality of compartments are sized to be accessed therethrough the rails of the mechanical lift platform.

According to another embodiment, a method of using a cabinet storage system is also disclosed herein. The method of using a cabinet storage system includes a providing a cabinet-box having a horizontal shelf opposite a closed-bottom, a vertical front-wall opposite a vertical back-wall, a vertical right-wall opposite a vertical left-wall, and an interior-volume contained therein, the interior-volume having, a plurality of compartments configured to receive and store items, the cabinet-box further having a lip integrally formed from a 90-degree bend of the vertical front-wall and configured to engage a top-rail of a mechanical lift platform. The steps may further include hanging the lip from the top-rail, and attaching a locking-mechanism under the top-rail.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a storage cabinet system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to storage devices for mechanical lift platforms and more particularly to a storage cabinet system and method as used to improve the storage and holding of items utilized with a mechanical lift platform.

Generally, mechanical lift platforms also known as articulated and telescopic lifts do not provide a proper place for holding and storing items (i.e. tools). The present disclosure may provide a system that is easily applied to any mechanical lift platform. The system may organize the items, making it more convenient for users. Further, the system is attached to the exterior of the mechanical lift platform, thus out of the way of the working area. Several security measures may be included for preventing the system or items from falling and potentially harming people below.

Referring now more specifically to the drawings by numerals of reference, there is shown in FIGS. 1-4, various views of a storage cabinet system 100 for a mechanical lift platform 10 having rails 20.

Figure 1:
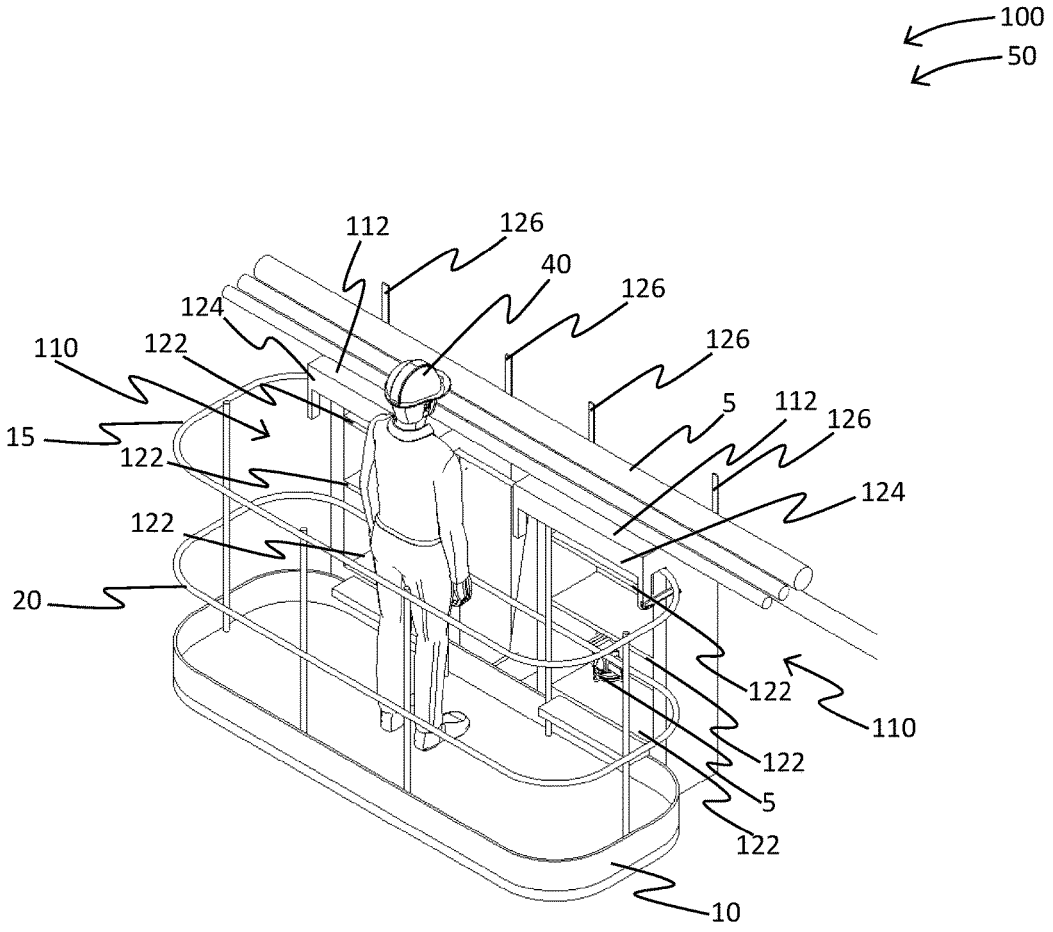
FIG. 1 is a perspective view of the storage cabinet system during an 'in-use' condition, according to an embodiment of the disclosure.

FIG. 1 shows a storage cabinet system 100 for a mechanical lift platform 10 having rails 20 during an 'in-use' condition 50, according to an embodiment of the present disclosure. Here, the storage cabinet system 100 may be beneficial for use by a user 40 to securely hold and store items 5 while on the mechanical lift platform 10. As illustrated, the storage cabinet system 100 may include a cabinet-box 110 having a horizontal shelf 112 opposite a closed-bottom 114, a vertical front-wall 116 opposite a vertical back-wall 117, a vertical right-wall 118 opposite a vertical left-wall 119, and an interior-volume 120 contained therein. The interior-volume 120 may have a plurality of compartments 122 configured to receive and store items 5. Further, a lip 124 integrally formed from a 90-degree bend of the vertical front-wall 116 may be configured to engage a top-rail 15 of the mechanical lift platform 10. The cabinet-box 110 may be configured to hang outside the rails 20 provided with the mechanical lift platform 10, and the plurality of compartments 122 are sized to be accessed therethrough the rails 20 of the mechanical lift platform 10.

One or more of the cabinet-boxes 110 may be arranged on either side of a control panel (not shown) associated with the mechanical lift platform 10. Utilizing more than one cabinet-box 110 may provide more surface area to store, place, and hold items 5 on the horizontal shelf 112 and the plurality of compartments 122. The cabinet-box 110 may be substantially rectangular, thus having an ergonomic size to better accommodate the mechanical lift platform 10. In addition, the cabinet-box 110 may comprise light-weight material, yet be durable to withstand outdoor conditions.

According to one embodiment, the storage cabinet system 100 may be arranged as a kit. In particular, the storage cabinet system 100 may further include a set of instructions. The instructions may detail functional relationships in relation to the structure of the storage cabinet system 100 such that the storage cabinet system 100 can be used, maintained, or the like, in a preferred manner.

Upon reading this specification, it should be appreciated that, under appropriate circumstances, considering such issues as user preferences, design preference, structural requirements, marketing preferences, cost, available materials, technological advances, etc., other cabinet-box 110 arrangements such as, for example, placement of the cabinet-box 110 on the mechanical lift platform 10, etc., may be sufficient.

Figure 2:
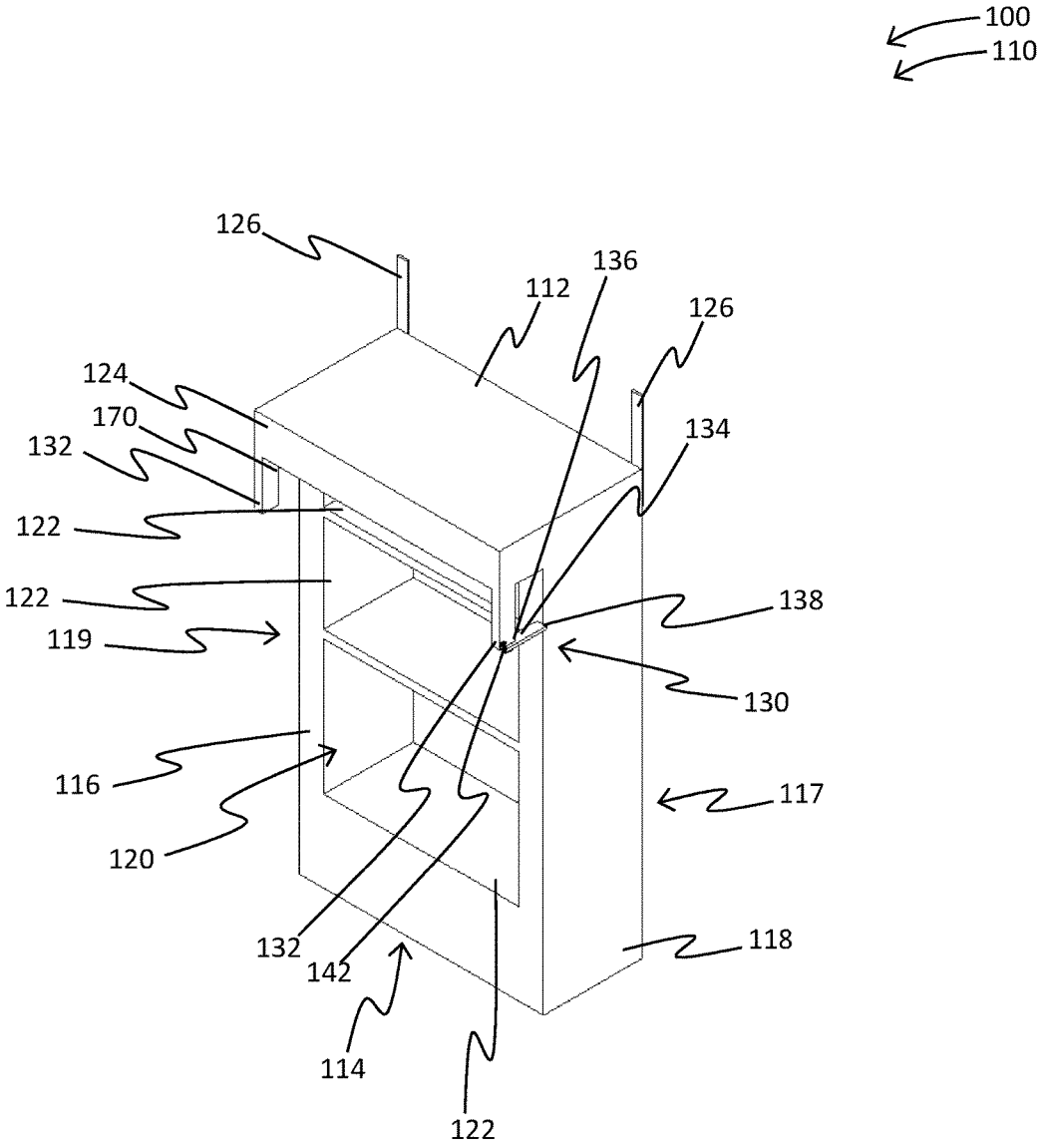
FIG. 2 is a perspective view of the storage cabinet system of FIG. 1, according to an embodiment of the present disclosure.

FIG. 2 shows the storage cabinet system 100 of FIG. 1, according to an embodiment of the present disclosure. As above, the storage cabinet system 100 may include the cabinet-box 110 having the horizontal shelf 112 opposite the closed-bottom 114, the vertical front-wall 116 opposite the vertical back-wall 117, the vertical right-wall 118 opposite the vertical left-wall 119, and the interior-volume 120 contained therein. The interior-volume 120 may have the plurality of compartments 122 configured to receive and store items 5. Further, the lip 124 integrally formed from the 90-degree bend of the vertical front-wall 116 may be configured to engage the top-rail 15 of the mechanical lift platform 10. The cabinet-box 110 may be configured to hang outside the rails 20 provided with the mechanical lift platform 10, and the plurality of compartments 122 are sized to be accessed therethrough the rails 20 of the mechanical lift platform 10.

The plurality of compartments 122 may include at least three compartments that may be horizontally arranged, one on top of the other. At least one of the plurality of compartments 122 may include dimensions for storing smaller sized items 5 (i.e., hammer, wrench, nails, etc.), and at least two of the plurality of compartments 122 may include dimensions for storing larger sized items 5 (i.e., oversized tools). The lip 124 may include a cut-out 170 for accessing the plurality of compartments 122, particularly the one on top.

Further, the storage cabinet system 100 may include a pair of adjustable support panels 126 at each end of the vertical back-wall 117. The pair of adjustable support panels 126 may be configured to be vertically raised and lowered over the horizontal shelf 112. The pair of adjustable support panels 126 may be utilized independently or dependently of each other.

Figure 3:
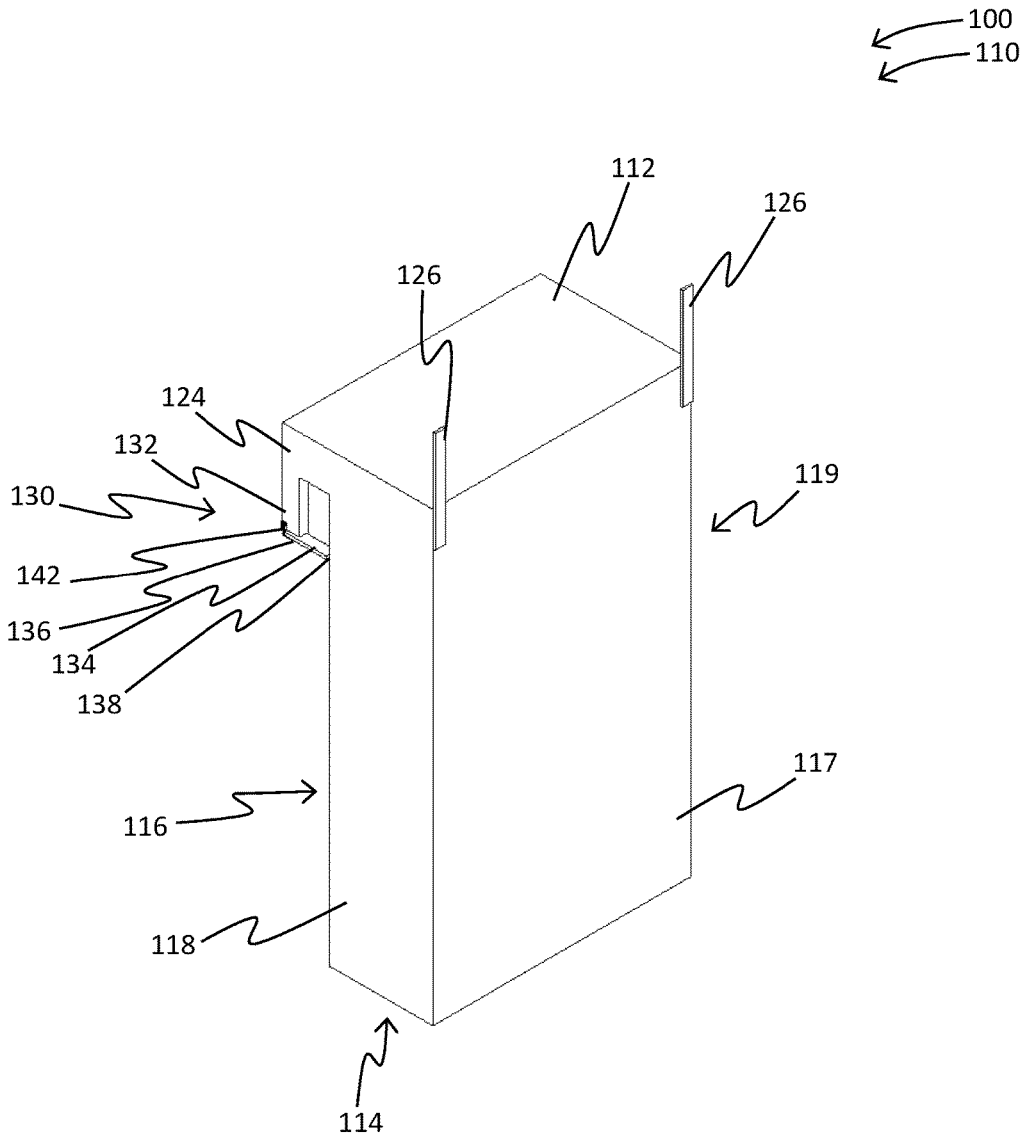
FIG. 3 is a rear perspective view of the storage cabinet system of FIG. 1, according to an embodiment of the present disclosure.

FIG. 3 is a rear perspective view of the storage cabinet system 100 of FIG. 1, according to an embodiment of the present disclosure. The pair of adjustable support panels 126 may be positioned at each end of the vertical back-wall 117. The pair of adjustable support panels 126 may be substantially rectangular, preventing misplacement of items 5 when placed on the horizontal shelf 112. Often, items 5 being tubular may easily roll and fall off the mechanical lift platform 10. The pair of adjustable support panels 126 may prevent such items 5 from becoming hazardous or inconvenient.

A locking-mechanism 130 may further be included with the cabinet-box 110 at a distal end 132 of the lip 124 for attaching under the top-rail 15 of the mechanical lift platform 10. In one embodiment, the locking-mechanism 130 may include a panel 134 having a first-end 136 and a second-end 138. The first-end 136 may be attached to a hinge 142 at the distal end 132 of the lip 124 and be configured to rotate 90 degrees coupling the second-end 138 to the vertical front-wall 116. The locking-mechanism 130 may further secure the cabinet-box 110 to the mechanical lift platform 10.

Figure 4:
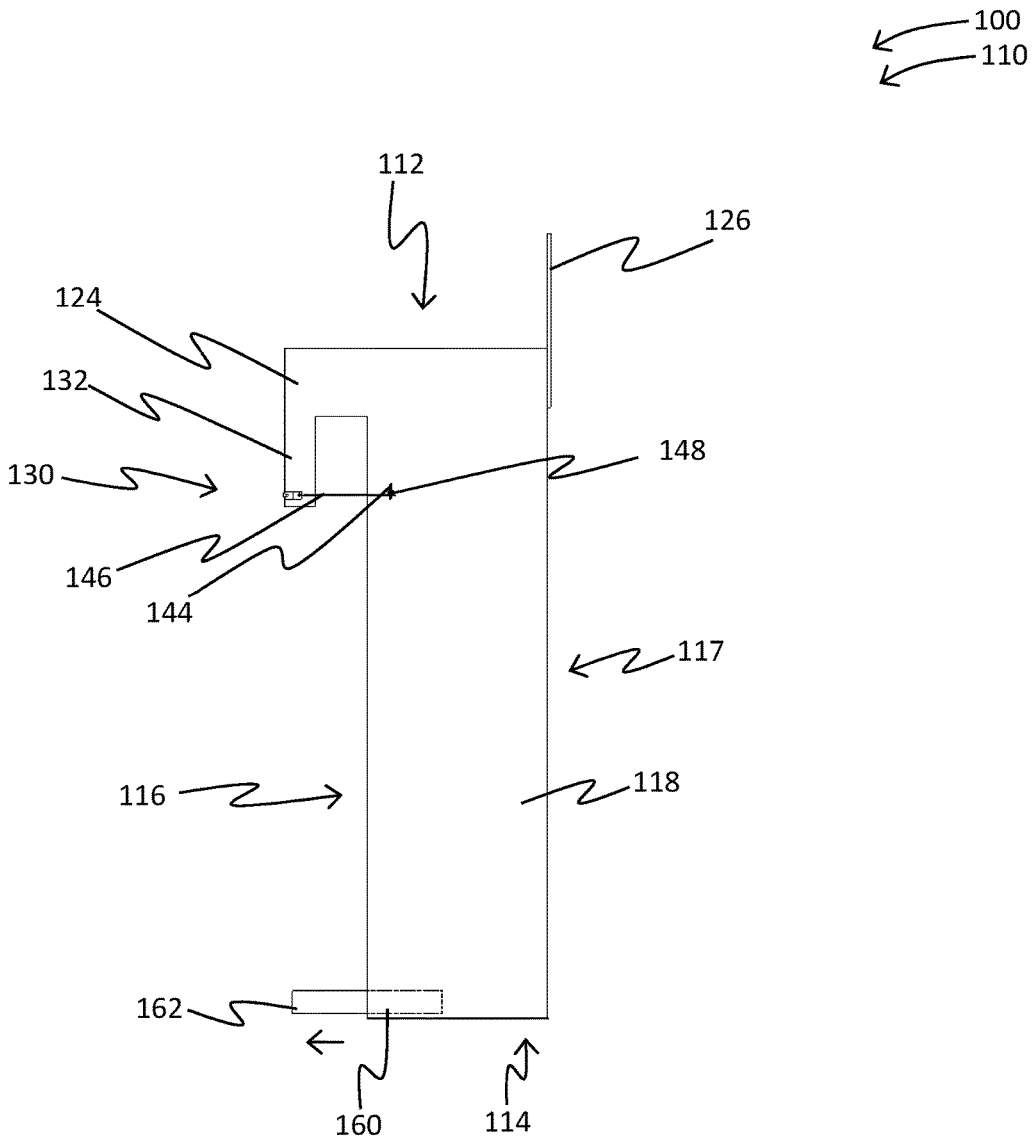
FIG. 4 is a side view of the storage cabinet system of FIG. 1, according to an embodiment of the present disclosure.

FIG. 4 is a side view of the storage cabinet system 100 of FIG. 1, according to an embodiment of the present disclosure. In another embodiment, the locking-mechanism 130 may include a pin 144 attached to a cord 146 at the distal end 132. The pin 144 may be configured to couple to an aperture 148 located at the vertical right-wall 118 and the vertical left-wall 119 (not shown).

The vertical front-wall 116 may further include an inner-cavity 160 towards the closed-bottom 114. The inner-cavity 160 may be configured to slideably engage a security-board 162 between a first-position inside the inner-cavity 160 and a second-position outside the inner-cavity 160. The second-position may be configured as an added security measure to prevent the cabinet-box 110 from detaching away from the mechanical lift platform 10.

Figure 5:
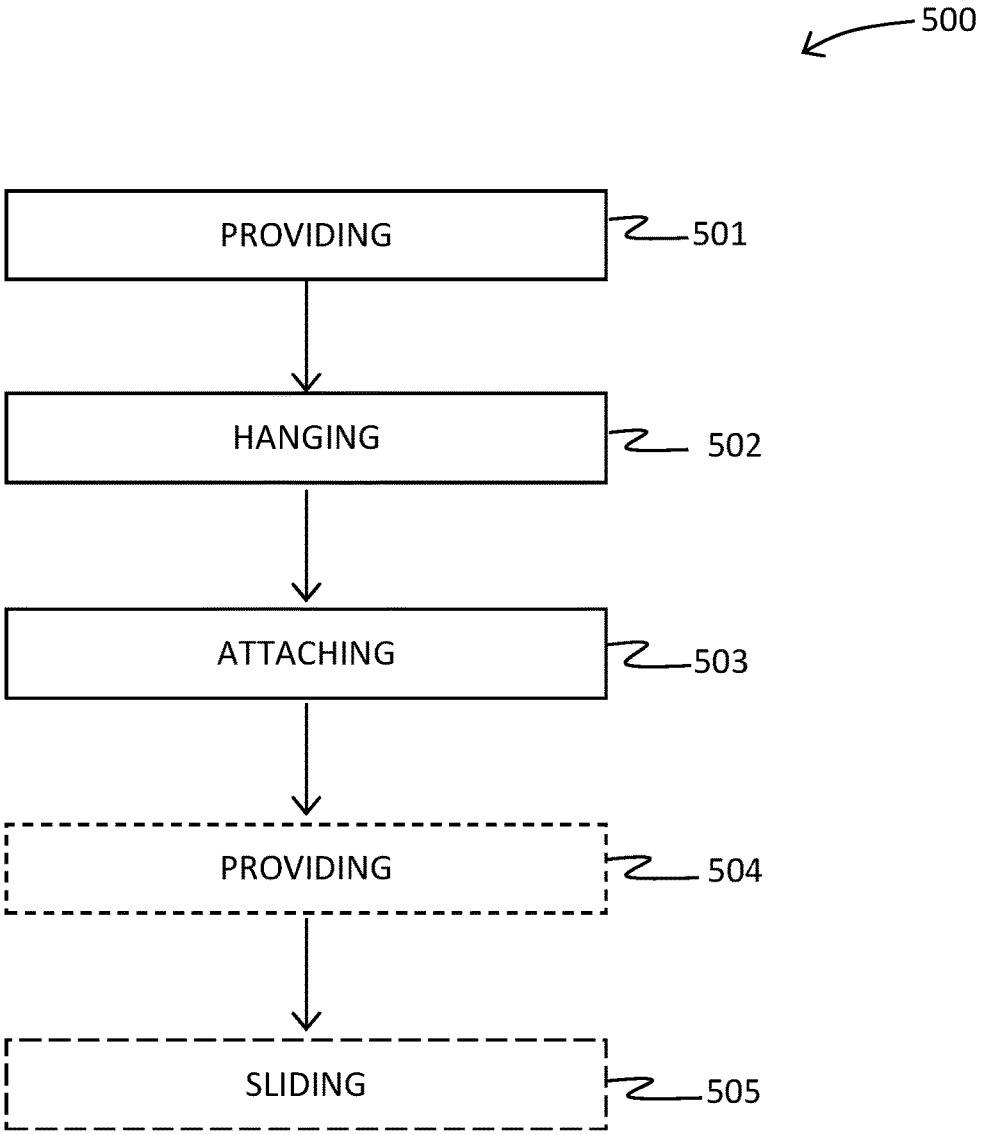
FIG. 5 is a flow diagram illustrating a method of using a storage cabinet system, according to an embodiment of the present disclosure.

FIG. 5 is a flow diagram illustrating a method for using a storage cabinet system 500, according to an embodiment of the present disclosure. In particular, the method for using a storage cabinet system 500 may include one or more components or features of the storage cabinet system 100 as described above. As illustrated, the method for using a storage cabinet system 500 may include the steps of: step one 501, providing a cabinet-box having a horizontal shelf opposite a closed-bottom, a vertical front-wall opposite a vertical back-wall, a vertical right-wall opposite a vertical left-wall, and an interior-volume contained therein, the interior-volume having, a plurality of compartments configured to receive and store items, the cabinet-box further having a lip integrally formed from a 90-degree bend of the vertical front-wall and configured to engage a top-rail of a mechanical lift platform; step two 502, hanging the lip from the top-rail; step three 503, attaching a locking-mechanism under the top-rail; step four 504, providing an inner-cavity in the vertical front-wall towards the closed-bottom, the inner-cavity configured to slideably engage a security-board; and step five 505, sliding the securing-board between a first-position inside the inner-cavity and a second-position outside the inner-cavity.

It should be noted that steps 504 and 505 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for attaching the storage cabinet system 100 to the mechanical lift platform 10 are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A storage cabinet system for a mechanical lift platform having rails, the storage cabinet system comprising:

a cabinet-box having a horizontal shelf opposite a closed-bottom, a vertical front-wall opposite a vertical back-wall, a vertical right-wall opposite a vertical left-wall, and an interior-volume contained therein, the interior-volume having a plurality of compartments configured to receive and store items;

a lip integrally formed from a 90-degree bend of the vertical front-wall and configured to engage a top-rail of the mechanical lift platform;

and a locking-mechanism at a distal end of the lip for attaching under the top-rail of the mechanical lift plat-form, wherein the locking-mechanism includes a panel having a first-end and a second-end, the first-end attached to a hinge at the distal end and configured to rotate 90 degrees and coupling the second-end to the vertical front-wall, wherein the cabinet-box is further configured to hang outside the rails provided with the mechanical lift platform;

and wherein the plurality of compartments are sized to be accessed therethrough the rails of the mechanical lift platform.

2. The storage cabinet system of claim 1, further comprising a pair of adjustable support panels at each end of the vertical back-wall, and wherein the pair of adjustable support panels are configured to be vertically raised and lowered over the horizontal shelf.

3. The storage cabinet system of claim 2, wherein the pair of adjustable support panels are utilized independently of each other.

4. The storage cabinet system of claim 2, wherein the pair of adjustable support panels are utilized dependently of each other.

5. The storage cabinet system of claim 1, wherein the locking-mechanism includes a pin attached to a cord at the distal end, the pin configured to couple to an aperture located at the vertical right-wall and the vertical left-wall.

6. The storage cabinet system of claim 1, wherein the vertical front-wall includes an inner-cavity towards the closed-bottom, the inner-cavity configured to slideably engage a security-board between a first-position inside the inner-cavity and a second-position outside the inner-cavity, and wherein the second-position is configured to prevent the cabinet-box from detaching away from the mechanical lift platform.

7. The storage cabinet system of claim 1, wherein one or more of the cabinet-boxes are arranged on either side of a control panel associated with the mechanical lift platform.

8. The storage cabinet system of claim 1, wherein the cabinet-box is substantially rectangular.

9. The storage cabinet system of claim 1, wherein the plurality of compartments includes at least three compartments.

10. The storage cabinet system of claim 9, wherein at least one of the plurality of compartments include dimensions for storing smaller sized items.

11. The storage cabinet system of claim 10, wherein at least two of the plurality of compartments include dimensions for storing larger sized items.

12. The storage cabinet system of claim 1, wherein the plurality of compartments are horizontally arranged, one on top of the other.

13. The storage cabinet system of claim 1, wherein the lip includes a cut-out for accessing the plurality of compartments.

14. The storage cabinet system of claim 1, wherein the cabinet-box comprises light-weight material.

15. A storage cabinet system for a mechanical lift having rails, the storage cabinet system comprising:

a cabinet-box having a horizontal shelf opposite a closed-bottom, a vertical front-wall opposite a vertical back-wall, a vertical right-wall opposite a vertical left-wall, and an interior-volume contained therein, the interior-volume having, a plurality of compartments configured to receive and store items;

a lip integrally formed from a 90-degree bend of the vertical front-wall and configured to engage a top-rail of the mechanical lift platform;

a pair of adjustable support panels at each end of the vertical back-wall;

and a locking-mechanism at a distal end of the lip for attaching under the top-rail of the mechanical lift platform, wherein the cabinet-box is further configured to hang outside the rails provided with the mechanical lift platform;

wherein the plurality of compartments are sized to be accessed therethrough the rails of the mechanical lift platform;

wherein the pair of adjustable support panels are configured to be vertically raised and lowered over the horizontal shelf;

wherein the pair of adjustable support panels are utilized independently of each other;

wherein the locking-mechanism includes a panel having a first-end and a second-end, the first-end attached to a hinge at the distal end and configured to rotate 90 degrees coupling the second-end to the vertical front-wall;

wherein the vertical front-wall includes an inner-cavity towards the closed-bottom, the inner-cavity configured to slideably engage a security-board between a first-position inside the inner-cavity and a second-position outside the inner-cavity;

wherein the second-position is configured to prevent the cabinet-box from detaching away from the mechanical lift platform;

wherein one or more of the cabinet-boxes are arranged on either side of a control panel associated with the mechanical lift platform;

wherein the cabinet-box is substantially 3D rectangular;

wherein the plurality of compartments includes at least three compartments;

wherein at least one of the plurality of compartments include dimensions for storing smaller sized items;

wherein at least two of the plurality of compartments is for storing larger sized items;

wherein the plurality of compartments are horizontally arranged, one on top of the other;

wherein the lip includes a cut-out for accessing the plurality of compartments;

and the cabinet-box comprises light-weight material.

16. The storage cabinet system of claim 15, further comprising set of instructions; and wherein the storage cabinet system is arranged as a kit.

17. A method of using a storage cabinet system, the method comprising the steps of:

providing the cabinet-box of claim 1, hanging the lip from the top-rail, and attaching a locking-mechanism under the top-rail.

18. The method of claim 17, further comprising the steps of providing an inner-cavity in the vertical front-wall towards the closed-bottom, the inner-cavity configured to slideably engage a security-board, and sliding the securing-board between a first-position inside the inner-cavity and a second-position outside the inner-cavity.

* * * * *